United States Patent [19]

Gapinski

[11] 4,386,630

[45] Jun. 7, 1983

[54] METHOD AND MEANS FOR INSULATING A PIPE

[76] Inventor: Maurycy A. Gapinski, 4800 E. 29th Ave., Lake Station, Ind. 46405

[21] Appl. No.: 408,182

[22] Filed: Aug. 16, 1982

Related U.S. Application Data

[63] Continuation of Ser. No. 220,521, Dec. 29, 1980, abandoned.

[51] Int. Cl.[3] ..... F27D 3/02

[52] U.S. Cl. ..... 138/149; 138/147; 138/158; 432/234

[58] Field of Search ..... 138/147, 149, 153, 158, 138/161, 174, 175, 176; 432/233, 234; 285/199

[56] References Cited

U.S. PATENT DOCUMENTS

| | | | |
|---|---|---|---|
| 2,352,145 | 6/1944 | Wright | 138/147 |
| 3,820,947 | 6/1974 | Boto et al. | 138/149 |
| 4,031,685 | 6/1977 | Heinz | 138/176 |
| 4,182,609 | 1/1980 | Hovis et al. | 432/234 |
| 4,225,307 | 9/1980 | Magera | 432/234 |
| 4,255,127 | 3/1981 | Skifano et al. | 138/147 |

FOREIGN PATENT DOCUMENTS

| | | | |
|---|---|---|---|
| 2405129 | 8/1974 | Fed. Rep. of Germany | 138/149 |
| 383277 | 12/1964 | Switzerland | 138/175 |
| 1442921 | 7/1976 | United Kingdom | 432/234 |
| 259115 | 4/1970 | U.S.S.R. | 432/234 |

*Primary Examiner*—John W. Shepperd
*Attorney, Agent, or Firm*—Walter Leuca

[57] ABSTRACT

A covering for insulating a pipe including a U-shaped refractory cast having embedded in the refractory cast a U-bolt, and a plurality of parallel rods welded to the bolt to form a cradle-like frame. The ends of the U-bolt project from the sides of the cast. The cast is seated against the pipe and supported thereto by assembling a collar member on each of the U-bolt ends. The sides of the collar members extend over and are seated against the pipe. Nut members are threaded to the bolt ends and tightened against the collar members. Refractory material in plastic form is applied to the pipe, covering the exposed portion of the pipe, the U-bolt ends, collars and nuts assembled thereto to completely insulate the pipe.

2 Claims, 5 Drawing Figures

METHOD AND MEANS FOR INSULATING A PIPE

This application is a continuation of application Ser. No. 220,521, filed Dec. 29, 1980 now abandoned.

BACKGROUND OF THE INVENTION

1. Field of the Invention

This invention relates to pipe insulators and more particularly to a method and means for supporting insulating forms on pipes.

2. Description of the Prior Art

In the steel industry, steel billets and slabs are heated in furnaces until they are malleable enough to be rolled in the rolling mill to various shapes. As the billets traverse through the furnace, they are supported on insulated pipes which are water cooled. A rib extends longitudinally on top of the pipe on which the billets and slabs are supported and are pushed along from the entrance to the exit of the furnace. The temperature of the furnace is approximately 2,200° F. and therefore, the supporting pipes are covered with refractory material and water cooled to keep the pipes at a temperature which would prevent the pipe support structure from bending or buckling or otherwise be destroyed under the intense heat and weight.

The prior art method of supporting the refractory insulating material around the pipe is to cast the refractory material around a pipe form and having embedded therein a chain link mesh or screen, the edges of which are exposed and free of the cast. The exposed edges of the wire screen are then tack-welded to the pipe when the cast form is assembled end to end to the pipe. Since the cast forms are made in semi-circular units so that they be assembled onto the pipes, the top of the pipe is exposed and therefore must be covered with refractory material to complete the protective encirclement with the exception of the top part of the longitudinal rib on which the billets skid.

The principal disadvantage of the prior art method above described is that in time, the insulation wears out or becomes damaged with use and needs to be replaced. The tack-welded chain link mesh which supports the refractory material to the pipe is removed by scarfing which is difficult and time-consuming especially since the pipe-support beds comprise a plurality of space parallel pipes which are approximately 200 feet long.

SUMMARY OF THE INVENTION

This invention is an improved method and means for supporting heat insulating refractory forms around a water cooled pipe. I form the refractory cast unit by providing a frame on which the refractory material is applied and to which it solidifies. This frame comprises a U-bolt having connected thereto in spaced parallel relationship, longitudinally extending wires or rods to form a semi-circular, cradle-like frame. The method of applying the refractory material to the frame may be accomplished by supporting the frame in a mold which admits insulating refractory material in a viscuous fluid state to cover the frame and to form a U-shaped cast upon solidification, allowing exposure of the threaded ends of the U-bolt. The longitudinal sides of the cast are formed opposingly slanted and elevated relative to an inner longitudinal ledge of the cast form. The inner longitudinal ledge is at a level approximately adjacent the diametrical line of the pipe to be covered. A plurality of cast units provided as above described are assembled end to end onto the pipe. A washer or collar is assembled to the threaded end of the U-bolt with the side of the washer bridging over to rest on the upper part of the pipe body. A nut is threaded onto the threaded end of the U-bolt and brought to bear against the washer tightening the U-bolt against the bottom section of the pipe thereby supporting each cast unit around the pipe.

The stepped longitudinal sides of the cast form provide a keyed profile to more securely connect the solidified refractory material to the cast form units at their interface.

Other objects and advantages of my invention will become more apparent after a careful study of the following detailed description taken together with the accompanying drawings which illustrate a preferred embodiment of my invention.

DETAILED DESCRIPTION OF THE INVENTION

Figure 1:
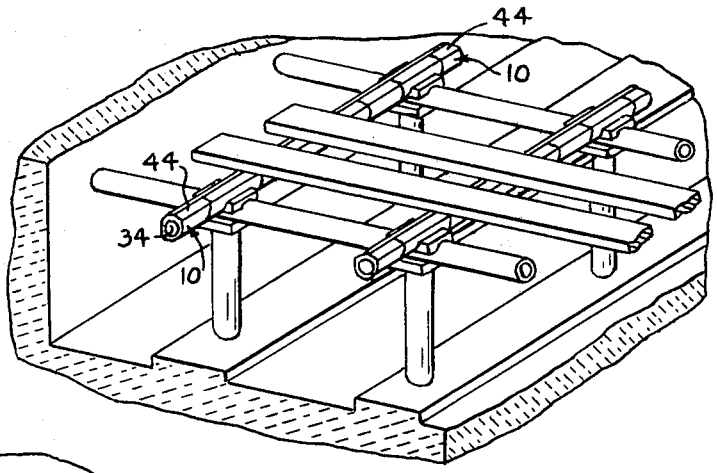
FIG. 1 is a perspective view of a billet heating furnace shown in section and in fragment to show the arrangement of the water cooled pipe skids on which the billets or steel slabs are moved through the furnace.
Figure 3:
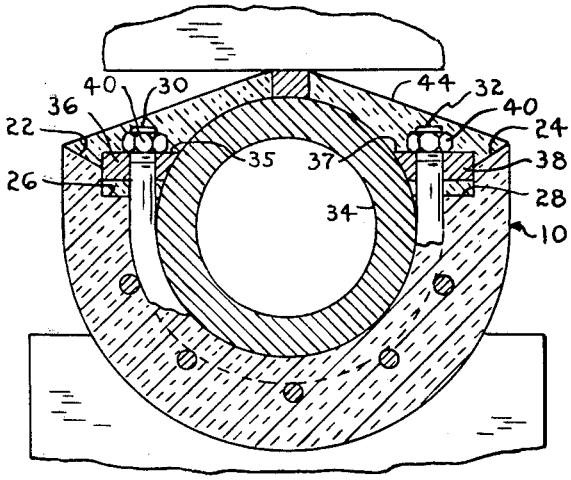
FIG. 3 is a cross-sectioned end view of the insulating cast form of my invention taken along lines 3—3 of FIG. 2.
Figure 2:
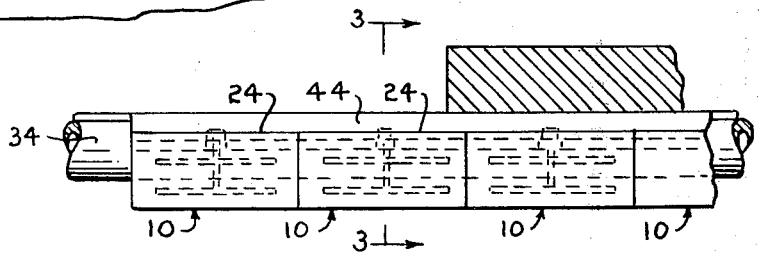
FIG. 2 is a side view of the water cooled pipes covered by the cast forms of my invention.
Figure 4:
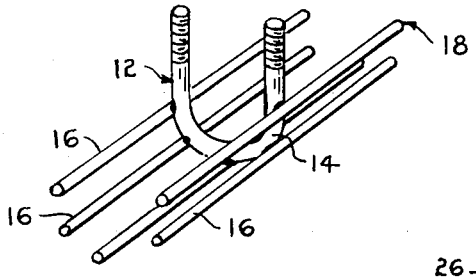
FIG. 4 is a perspective view of the frame component of the cast form of my invention.
Figure 5:
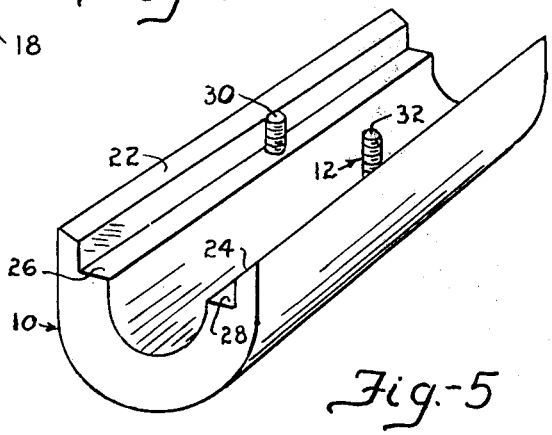
FIG. 5 is a perspective view of the cast form unit of my invention.

Referring now more particularly to the drawings, numeral 10 designates generally the pipe insulating cast unit of my invention. It comprises a U-bolt 12 having connected to the semi-circular body portion 14 of U-bolt 12, a plurality of rods 16, preferably by weldments, to form a cradle-like frame 18. The U-bolt, cradle-like frame combination is supported in an appropriate annular mold (not shown) in which is introduced heat insulating refractory material in plastic or liquid form which covers frame 18, and upon solidification forms cast 10, substantially semi-circular in shape. The cast is formed with opposingly slanted longitudinal sides 22 and 24 extending above the diametrical line of the semi-circular shaped body. Longitudinal sides 22 and 24 are stepped to provide inwardly extending ledges or shoulders 26 and 28 from which the threaded ends 30 and 32 of U-bolt 12, respectively, project.

The insulating cast form 10 of my invention is connected to a pipe, particularly water cooled skid pipe 34, by seating the concave body of cast unit 10 against pipe 34. Washer or collar elements 36 and 38 are assembled onto threaded ends 30 and 32 respectively, so that the inwardly extending sides 35 and 37 of collar elements 36 and 38, respectively, are seated on the top of pipe 34. Nuts 40 and 42 are threaded on ends 30 and 32 of U-bolt 12 wedging inwardly extending sides 35 and 37 of collars 36 and 38, respectively, between bolt ends 30 and 32 and the body of pipe 34. I then apply heat refractory material 44 in a plastic or viscuous fluid state on the exposed top part of pipe 34 and U-bolt ends 30 and 32 completely covering the pipe 34 and the U-bolt nut assemblies, 30, 36, 40 and 32, 38, 42. The stepped longitudinal sides 22 and 24 provide a keyed interface for the plastic heat insulating refractory material 44 applied to the top side so that when it solidifies, a secure connection is made with the cast form 10. Besides providing an enlarged interface to make a better connection between the cast form 10 and refractory material 44, the shoulders 26, 28 being at a lower level than the upstanding slanted sides 22, 24, respectfully, provide a recessed part for receiving the collar members 36 and 38 when wedged downwardly by nut means 40 within the confines of sides 22 and 24. This allows coverage thereover by insulating material 44 with greater thickness.

When the refractory material loses its effectiveness because of destruction due to use and prolonged heat and it is required to replace the refractory insulation with new cast forms 10, the refractory material 44 on top of the pipe is chipped away to expose the end 30, 32 of U-bolts 12, and the nuts 40, 42 are burned away or broken off with hammer blows which can easily be done due to the oxidation of the collar or washer, nuts and U-bolt ends. Removing or loosening the collars or washers 36, 38 from U-bolt ends 30, 32 respectively allows the cast forms 10 to drop down or be removed from the pipe quickly and with ease thereby dismantling the insulation from the skid pipe rapidly and with very little labor and no damage to the skid pipe allowing new refractory forms of this invention to be reapplied to the pipe.

I claim:

1. An insulating form comprising:

a longitudinal body having opposingly coterminous sides, and being U-shaped in cross section for longitudinal seating against a pipe, said coterminous sides having inwardly extending shoulders and opposingly slanted sides extending above said shoulders;

a U-bolt embedded in a cross section of said body, the ends of said bolt projecting from said inwardly extending shoulders being threaded;

a collar member on each end of said bolts and being within the confines of said sides extending above said shoulders, a part of said collar member extending over a part of said other side of said pipe;

threaded means for connecting each of said threaded end of said bolt and moveable thereon against said collar member to wedge said collar member between said ends of said bolt and said part of said other side of said pipe; and a plurality of rods embedded longitudinally in said body, said rods being connected to said U-bolt.

2. An insulating pipe cover comprising:

a plurality of cast forms each thereof having opposingly coterminous sides and being U-shaped in cross section, said plurality of forms abutting end to end to collectively cover one side of a pipe, said coterminous sides comprising inward extending shoulders and opposingly slanted sides extending above said shoulders;

a U-bolt embedded in a cross section of each of said forms, the ends of said bolt projecting from said inwardly extending shoulders of said sides being threaded;

a plurality of rods embedded longitudinally in each of said forms, said rods being connecting to said U-bolt;

a collar member on each end of said bolt, said collar member being within the confines of said side extending above said shoulder, a part of said collar member extending over a part of said other side of said pipe;

threaded means for connecting each of said threaded ends of said bolt and moveable thereon against said collar member to wedge said collar member against said end of said bolt and said part of said other side of said pipe for supporting said forms against said one side of said pipe; and heat insulating material in homogeneous form covering said other side of said pipe, said inwardly extending shoulders, said opposingly slanted sides of said plurality of cast forms, and encasing said ends of said bolts, said collar members and said means connecting said ends of said bolts.

* * * * *